US007479037B2

(12) United States Patent
Bernat et al.

(10) Patent No.: US 7,479,037 B2
(45) Date of Patent: Jan. 20, 2009

(54) SHIELDING CONTACT FOR A CONNECTOR HOUSING

(75) Inventors: Jean Francois Bernat, Sartouville (FR); Jean-Merri de Vanssay, Paris (FR); Alexandre Mermaz, Paris (FR)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 11/861,036

(22) Filed: Sep. 25, 2007

(65) Prior Publication Data

US 2008/0090456 A1 Apr. 17, 2008

(30) Foreign Application Priority Data

Oct. 12, 2006 (DE) ..... 20 2006 015 641 U

(51) Int. Cl.
*H01R 9/03* (2006.01)

(52) U.S. Cl. ..... 439/610

(58) Field of Classification Search ..... 439/607, 439/610, 393, 98–99
See application file for complete search history.

(56) References Cited

U.S. PATENT DOCUMENTS 4,170,395 A * 10/1979 Sommerfeldt et al. ..... 439/833
4,653,825 A * 3/1987 Olsson ..... 439/295
4,713,023 A * 12/1987 Bixler et al. ..... 439/393
4,990,094 A * 2/1991 Chandler et al. ..... 439/108
5,232,380 A * 8/1993 Inoue et al. ..... 439/610
5,397,246 A * 3/1995 Defibaugh et al. ..... 439/352
5,417,590 A * 5/1995 Dechelette et al. ..... 439/607
5,437,563 A * 8/1995 Kihira et al. ..... 439/607
5,533,914 A * 7/1996 Sawada ..... 439/843
5,733,146 A * 3/1998 Block ..... 439/610
6,296,519 B1 * 10/2001 Hashizawa et al. ..... 439/607
6,783,397 B2 8/2004 Yang Lee ..... 439/607
7,052,292 B2 5/2006 Hsu et al. ..... 439/98

* cited by examiner

*Primary Examiner*—Michael C Zarroli
(74) *Attorney, Agent, or Firm*—Hayes Soloway P.C.

(57) ABSTRACT

A connection between a shielding sleeve of a connector housing and an inner as well as an outer braided shield of an electric cable is produced by providing a shielding sleeve with a contact, the end piece of which has an omega-like shape and regionally encompasses the braided shield in a contacting fashion, in which an additional contact tab protruding out of the contact pad is provided for contacting the braided shield.

7 Claims, 5 Drawing Sheets

SHIELDING CONTACT FOR A CONNECTOR HOUSING

BACKGROUND OF THE INVENTION

1. Field of the Invention

The invention pertains to a shielding contact for connecting an electrically shielded connector housing to an electric cable that is equipped with at least one braided shield.

A shielding contact of this type is required for ensuring the shielding effect of shielded electric cables against interfering radiation through a plug-and-socket connection.

2. Description of the Related Art

Many different versions for connecting a connector with shielding effect to the shield of an electric cable are known.

For example, U.S. Pat. No. 6,783,397 describes a connector, the two-part shielding housing of which features a ribbed metal strip on its cable connection side, wherein this ribbed metal strip is bent around the cable sheath in order to secure the electric cable.

In addition, U.S. Pat. No. 7,052,292 discloses a connector with a grounding structure that features an oval ring or is bent into an oval ring and ultimately contacts the shield of two adjacently arranged differential signaling lines. In this case, the ring simultaneously serves for retaining the signaling lines.

SUMMARY OF THE INVENTION

The invention is based on the objective of realizing a shielded connector housing with a shielding contact of the initially cited type in such a way that a simple connection between the braided shield of an electric cable and a shielding sleeve that surrounds the plug-in contacts in a contact carrier can be produced without tools.

This objective is attained in that a contact carrier arranged in the connector housing is surrounded by a shielding sleeve with a contact part, by means of which an electrically conductive connection with the shield of the electric cable can be produced, wherein the contact part encompasses the outer shield or the inner shield in a contacting fashion with an end piece of omega-like shape. The electric cables may contain one or more braided shields.

The described connector housing with a surrounding shielding sleeve is intended for transferring shielded signaling lines and for forwarding supply voltages or supply currents, respectively.

The advantages attained with the invention can be seen, in particular, in that the shielding sleeve is realized with a shielding contact that is simply snapped on the cable shield of the shielded electric cable in order to transfer the shield potential to the connector. For this purpose, the shielding contact is realized in the form of a contact part that is exposed on three sides and can be easily bent onto the cable shield without tools in order to produce a clamping connection with a so-called omega end piece. The omega end piece approximately has the shape of a pipe section, the cross-section of which extends over three-quarters of a circle and features outwardly bent segments such that it corresponds to the Greek letter omega (Ω). In addition, a contact tab that is exposed on three sides and makes it possible to realize an additional contact is integrated into the contact part.

It is advantageous that several variations of connections can be used for producing a connection between the connector and the shield of the electric cable with the omega end piece:

1. The contact part acts upon an outer shield of an electric cable with the omega end piece.

2. The contact part acts upon an inner shield of a correspondingly realized electric cable with the omega end piece, wherein the tab inevitably acts upon the inner shield as well.

3. The contact part acts upon the outer shield with the omega end piece and upon the inner shield with the contact tab.

BRIEF DESCRIPTION OF THE DRAWINGS

One embodiment of the invention is illustrated in the figures and described in greater detail below. The figures show.

DESCRIPTION OF THE PREFERRED EMBODIMENTS

Figure 1:
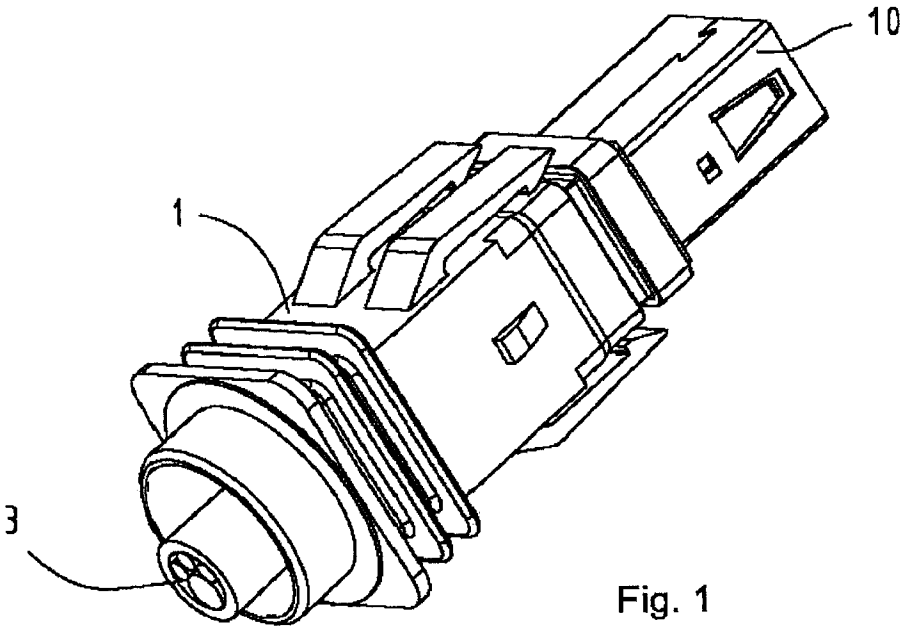
FIG. 1 is a connector with an electric cable.

FIG. 1 shows a so-called push-pull connector with a contact carrier 2 that is surrounded by a shielding sleeve 10, on which a connector housing 1 is displaceably arranged, as well as an electric cable 3 that contains signaling lines 5 and power supply lines 6.

Figure 2:
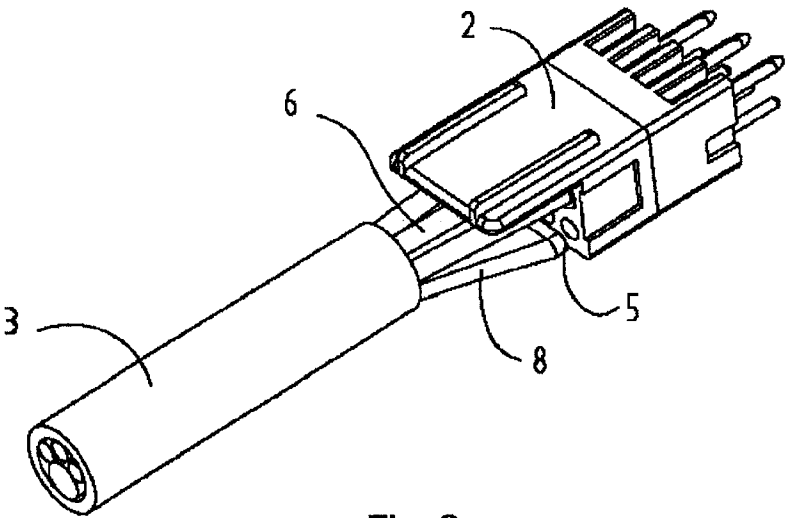
FIG. 2 is a contact carrier of the connector.

FIG. 2 shows the contact carrier 2 with electric plug-in contacts and the electric cable 3 connected thereto, namely without the surrounding connector housing 1. In this case, the signaling lines 5 are surrounded by a common inner shield 8.

Figure 3B:
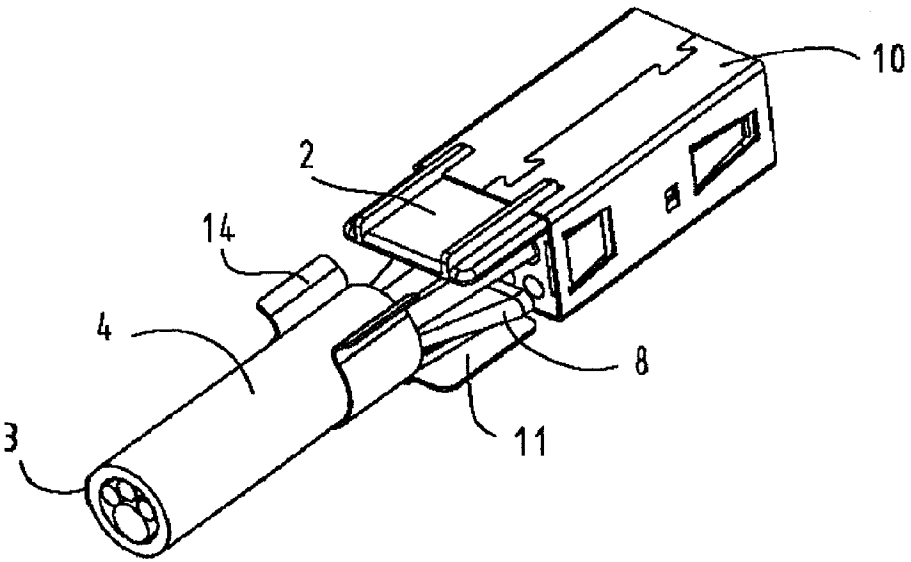
FIG. 3*b* is an end piece of the contact part that encompasses the cable.
Figure 3A:
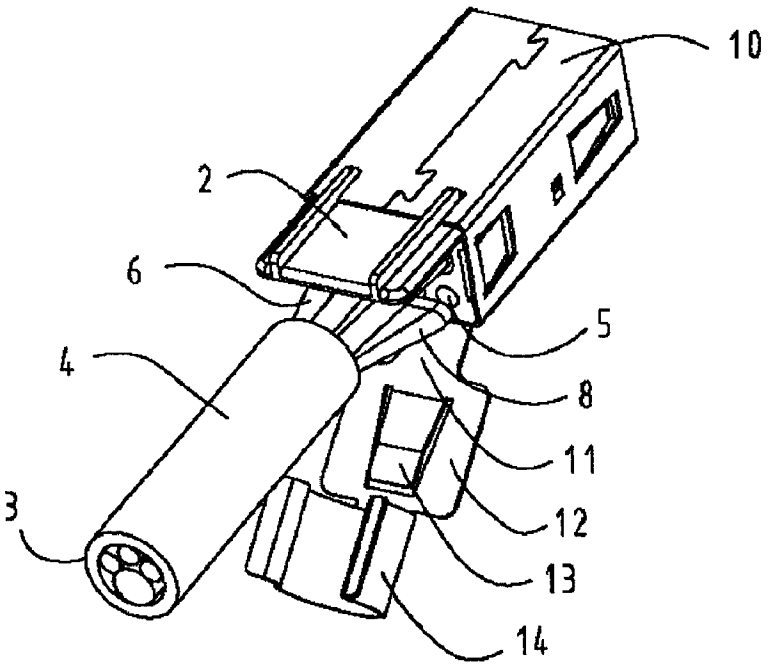
FIG. 3*a* is a contact carrier with a surrounding shielding sleeve that features an angled contact part.

FIG. 3*a* shows the electrically insulating contact carrier 2 with the electric lines 5, 6 of the cable 3, as well as the electrically conductive shielding sleeve 10 that surrounds the contact carrier 2 and is provided for shielding purposes. A contact part 11 with an end piece 14 of omega-like shape is integrally formed onto the shielding sleeve 10. A nearly square surface 12 with a contact tab 13 that is exposed on three sides and points toward the electric cable is provided within the contact part between the end piece 14 and its connection to the shielding sleeve 10, wherein said contact tab ensures that a common inner shield 8 of the signaling lines 5 is also contacted.

According to FIG. 3*b*, the angled contact part 11 is bent in the direction of the electric cable 3 in such a way that the end piece 14 encompasses the sheath 4 of the electric cable 3 in a clamping fashion with its omega-like structure.

Figure 4B:
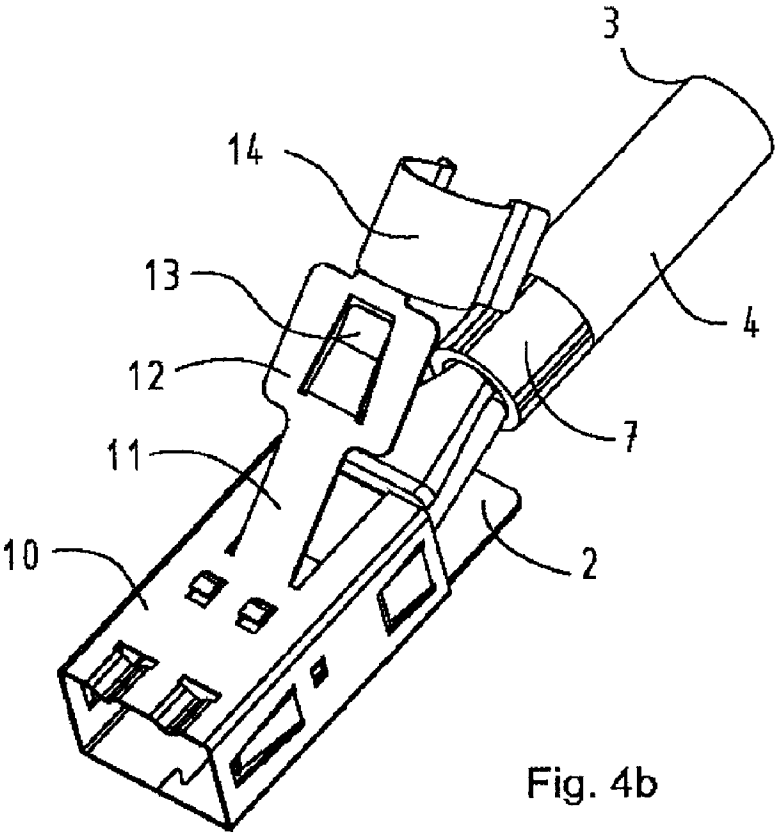
FIG. 4*b* is the contact carrier with surrounding shielding sleeve and angled contact part.
Figure 4A:
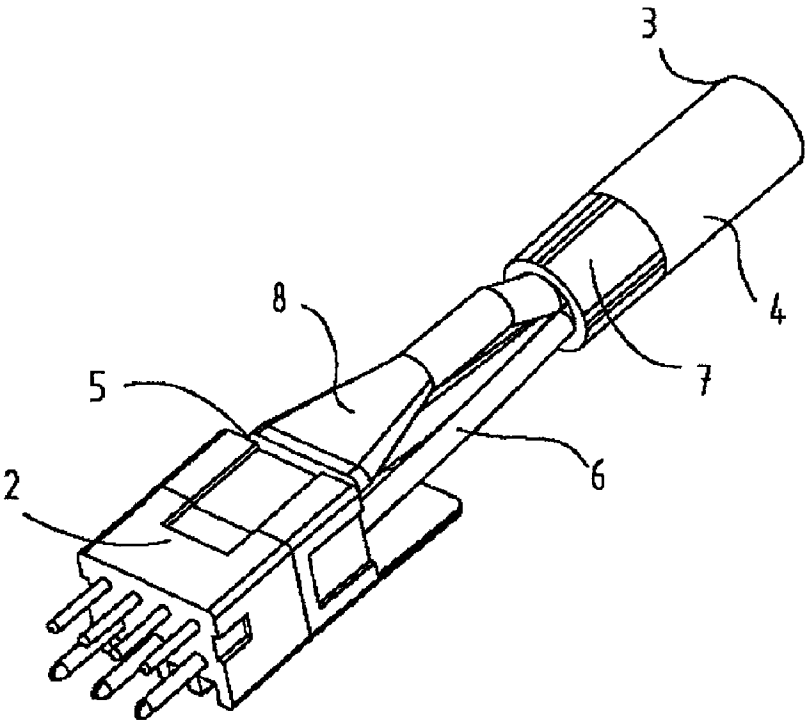
FIG. 4*a* is a contact carrier with a partially stripped electric cable.
Figure 5A:
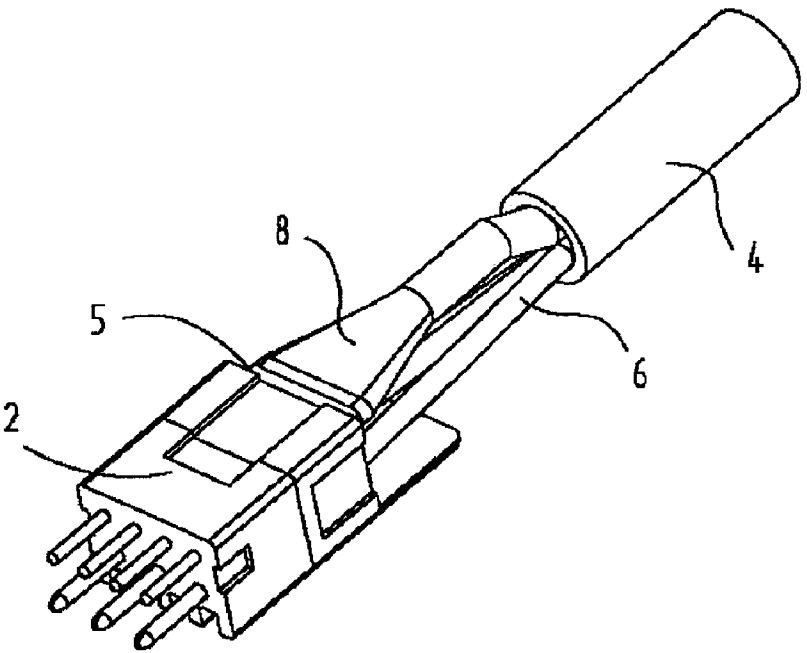
FIG. 5*a* is the contact carrier with shielded signaling lines.

FIG. 4*a* shows the contact carrier 2 with the electric cable 3 that features an exposed outer shield 7 for the entire cable and another common inner shield 8 for the signaling lines 5 only underneath its outer sheath 4.

Figure 4C:
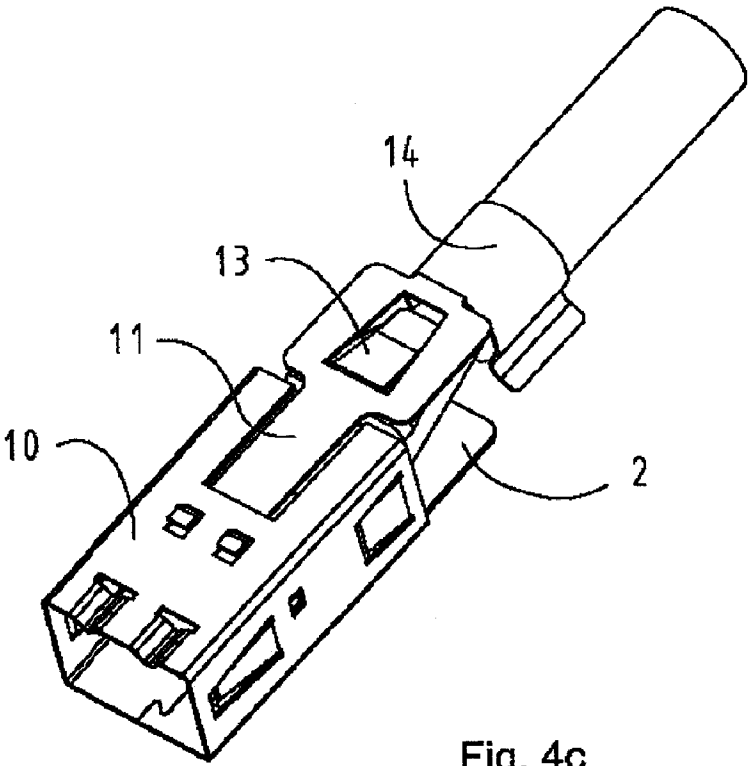
FIG. 4*c* is the contact carrier with surrounding shielding sleeve and an end piece that contacts the outer shield of the electric cable.
Figure 5C:
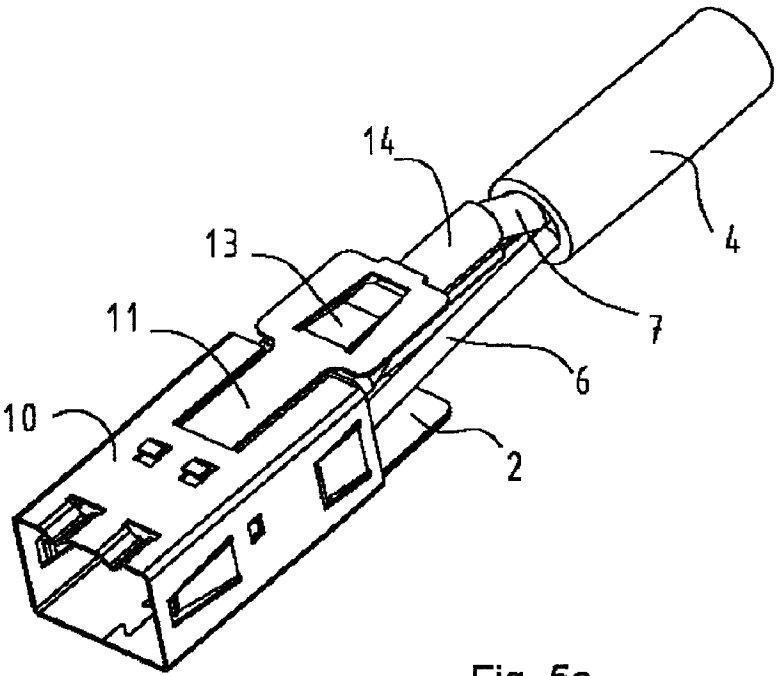
FIG. 5*c* is the contact carrier with surrounding shielding sleeve and an end piece that contacts the inner shield of the electric cable.
Figure 5B:
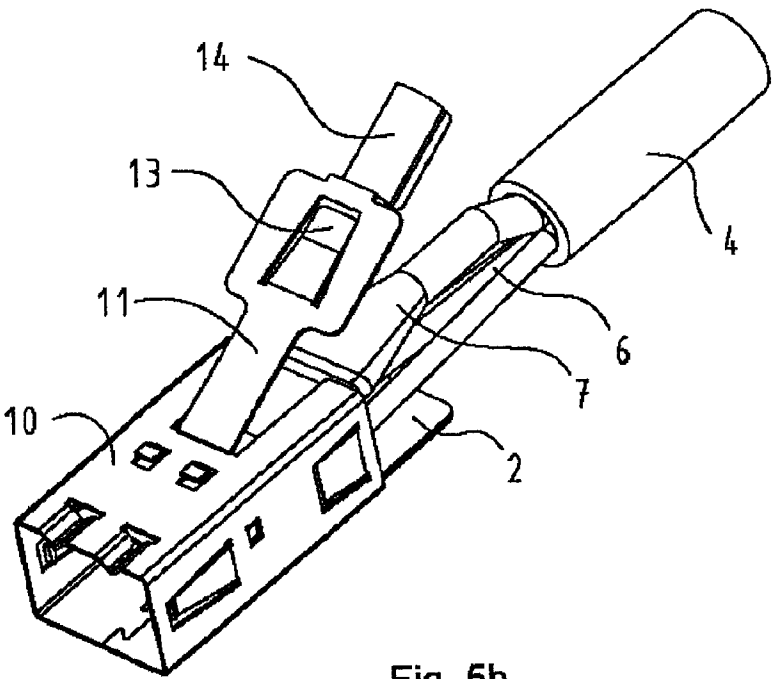
FIG. 5*b* is the contact carrier with surrounding shielding sleeve and angled contact part.

FIG. 4*b* shows the contact carrier 2 with the shielding sleeve 10 that also features an angled contact part 11 that contacts the outer shield 7 with the omega end piece 14 in FIG. 4*c*, wherein the contact tab 13 simultaneously contacts the inner shield 8.

Analogous to the cycle of FIG. 4, FIGS. 5*a*, 5*b*, 5*c* also show how the omega end piece 14 of the shielding sleeve 10 and the contact tab 13 merely encompass and contact the inner shield 8 of the signaling lines 5 in a clamping fashion.

What is claimed is:

1. A shielding contact for connecting a shielding sleeve arranged within a connector housing to an electric cable that is equipped with one or two braided shields, wherein a contact carrier is arranged in the connector housing and surrounded by the shielding sleeve with a contact part, wherein said contact carrier makes it possible to produce an electrically conductive connection with one or both shields of the electric cable, and wherein the contact part encompasses at least either an outer braided shield or an inner braided shield in a contacting fashion with an omega-shaped end piece.

2. The shielding contact according to claim 1, wherein the contact part is exposed on three sides shaped out of the shielding sleeve.

3. The shielding contact according to claim 2, wherein the contact part comprises a contact tab that is exposed on three sides and provides for contacting the inner braided shield of the electric cable.

4. The shielding contact according to claim 1, wherein the omega-shaped end piece encompasses a sheath of the electric cable in a clamping fashion.

5. A shielding contact for connecting a connector housing to an electric cable that is equipped with at least one braided shield, wherein a contact carrier is arranged in the connector housing and surrounded by a shielding sleeve with a contact part, wherein said contact carrier makes it possible to produce an electrically conductive connection with a shield of the electric cable, and wherein the contact part encompasses an outer shield or an inner shield in a contacting fashion with an omega-shaped end piece, wherein the contact part is exposed on three sides and therefore springably shaped out of the shielding sleeve.

6. The shielding contact according to claim 5, wherein a springable contact tab protruding out of the contact part is exposed on three sides and provided for contacting the inner shield of the electric cable.

7. A shielding contact for a connector housing to an electric cable that is equipped with at least one braided shield, wherein a contact carrier is arranged in the connector housing and surrounded by a shielding sleeve with a contact part, wherein said contact carrier makes it possible to produce an electrically conductive connection with a shield of the electric cable, and wherein the contact part encompasses an outer shield or an inner shield in a contacting fashion with an omega-shaped end piece, wherein a springable contact tab protruding out of the contact part is exposed on three sides and provided for contacting the inner shield of the electric cable.

* * * * *

UNITED STATES PATENT AND TRADEMARK OFFICE

CERTIFICATE OF CORRECTION

PATENT NO. : 7,479,037 B2
APPLICATION NO. : 11/861036
DATED : January 20, 2009
INVENTOR(S) : Bernat et al.

It is certified that error appears in the above-identified patent and that said Letters Patent is hereby corrected as shown below:

Title Page; item (57);
In the abstract, line 7, “the contact pad is provided” should be --the contact part is provided--.

Signed and Sealed this

Fourteenth Day of July, 2009

John Doll

JOHN DOLL
*Acting Director of the United States Patent and Trademark Office*